United States Patent [19]

Theault

[11] Patent Number: 4,800,691

[45] Date of Patent: Jan. 31, 1989

[54] SELF-SUPPORTING ELEMENT FOR THE CONSTRUCTION OF A BUILDING ROOF, COMPRISING A METAL FRAMEWORK ASSOCIATED WITH A SINGLE-UNIT INSULATING CLADDING, METAL FRAMEWORK AND INSULATING CLADDING CONSTITUTING SAID ELEMENT, AND THE RESULTING ROOF

[75] Inventor: Yves L. Theault, Tracy-Sur-Mer, France

[73] Assignee: Theault & Cie, Arromanches, France

[21] Appl. No.: 2,653

[22] PCT Filed: May 7, 1986

[86] PCT No.: PCT/FR86/00159

§ 371 Date: Dec. 8, 1986

§ 102(e) Date: Dec. 8, 1986

[87] PCT Pub. No.: WO86/06776

PCT Pub. Date: Nov. 20, 1986

[30] Foreign Application Priority Data

May 7, 1985 [FR] France ..... 85 06945

[51] Int. Cl.[4] ..... E04B 7/10; E04C 2/50

[52] U.S. Cl. ..... 52/90; 52/809

[58] Field of Search ..... 52/90, 809

[56] References Cited

FOREIGN PATENT DOCUMENTS 2489395 3/1982 France .
2525659 10/1983 France .
2527671 12/1983 France .

*Primary Examiner*—J. Karl Bell
*Attorney, Agent, or Firm*—William R. Hinds

[57] ABSTRACT

The self-supporting element (1) is of great length and of the type formed by a framework of metal section members (7-9-10-11-14-15) and an insulating cladding supported by the framework. The element is characterized in that its cladding is in a single unit and formed by a composite comprising an outer skin (17), an inner skin (18) and an insulating blanket (19) formed by mineral wool fibres which extend in a direction perpendicular to the parallel planes of the skins. The cladding (16) is supported exclusively by the two lateral beams (9,10) of the framework.

30 Claims, 10 Drawing Sheets

IV
IV
III
III
75
5
11
15
22
13
22
77
13
12
22
77
10
75
11
11
4
7
14
23
6
17
28
1
19
18
23

SELF-SUPPORTING ELEMENT FOR THE CONSTRUCTION OF A BUILDING ROOF, COMPRISING A METAL FRAMEWORK ASSOCIATED WITH A SINGLE-UNIT INSULATING CLADDING, METAL FRAMEWORK AND INSULATING CLADDING CONSTITUTING SAID ELEMENT, AND THE RESULTING ROOF

The present invention relates to a self-supporting element of great length for the construction of a roof of a building and in particular an industrial building (workshop, warehouse, hall), commercial building (covered market), school, sports, or administration building, or a building for living quarters, and the roof formed by the combination of a plurality of these elements disposed parallel to each other and assembled along their longitudinal edges.

It is already known to roof buildings by means of self-supporting elements of great length which are assembled in pairs along their longitudinal edges so as to form in this case a roof having one row and which are sometimes also assembled in pairs by the abutment of their tranverse end edges so as to form in this case a roof having two or more rows of juxtaposed elements.

These self-supporting elements are very often equipped in the workshop with devices performing the future technical functions of the building, such as the insulation, lighting, heating, ventilation, protection against fire, discharge of smoke, so that the functional equipment to be provided on the building site are reduced to a minimum.

Indeed, it is sufficient to bring to the site the elements manufactured in accordance with such a design, raise them and place them on the existing supporting structure (framework of metal or concrete), assemble them in pairs by their longitudinal edges and, as the case may be, by their transvers end edges, and finally connect the technical devices of each element to the electrical, hot water or steam supplies for example, for the building to be completely equipped in a functional way at the same time as it is insulated and protected from the weather.

The self-supporting elements available at the present time in the field of building roofs are either of concrete or of protected steel sheets which cover a blanket or layer of glass wool supported by the under-sides rendered integral with the outer sheets by connecting devices which are most often simultaneously associated with the technical devices which in this way participate in the supporting of the under-sides and the insulating blanket.

The concrete elements have the obvious drawback of being particularly heavy; the elements of protected steel sheet, such as those disclosed in French patent Nos. 1,558,925 and 71 28,624/2,147,866, have the drawback of being relatively complex and therefore expensive to manufacture. In the latter elements, the blankets of glass wool which provide the insulation of the buildings are produced by the most conventional technique, the fibres of the glass wool extending along planes substantially parallel to the large surfaces of the blankets.

In order to simplify manufacture of such self-supporting elements and also simplify their transport between the place of manufacture and the site of their assembly, it has been envisaged to construct the self-supporting elements by the association of two main constituents, on one hand, a framework of metal section elements extending in a continuous manner between the two longitudinal edges of the element and between its two transverse end edges so as to ensure the selfsupporting character of said element, and, on the other hand, an insulating cladding capable of being supported by said framework.

Elements of this type, such as those disclosed for example in French patent application Nos. 82 07272 (French patent No. 2,525,659) and 82 09304 (French patent No. 2,527,671) have the advantage of being capable of being assembled as a framework-cladding unit indifferently in the workshop or on the building site.

If the manufacture of the two main components of each self-supporting element is carried out in the same factory, the metal frameworks on one hand and the insulating claddings on the other may be stored independently.

But, and it is in this respect that these new designs present a great advantage, the metal frameworks and the insulating claddings may be manufactured in two distinct places, the noble constituents forming the insulating claddings being made in the factory and then transported to the assembly sites, the less noble constituents forming the metal frameworks being ideally constructed in the vicinity of the building sites and even on the sites themselves.

The transport costs of such self-supporting elements are thus markedly reduced. Moreover, it becomes possible to entrust the complete or partial construction to firms close to the assembly site as a result of delivery of each metal framework in kit form.

Apart from the reduction in transport costs, above all to very remote countries, the fact of being able to construct on the site or in the vicinity of the site all, or at least a part, of each metal framework, is of obvious interest in developing countries particularly engaged in a building construction policy involving large ground areas.

The self-supporting elements disclosed in the aforementioned French patent applications each comprise a framework of continuous metal section elements between its two longitudinal edges and its two transverse end edges so as to afford the self-supporting character, and an insulating cladding formed by the juxtaposition of a plurality of sections which are placed and fixed on the framework and are individually capable of being disassembled. The proposed variants of frameworks which are symmetrical or disymmetrical, permit the construction of roofs with skylights for a partly natural lighting of the buildings, or solid roofs which are better protected from the sun but require a permanent artificial lighting. The insulating claddings proposed by the two aforementioned French patent applications have in common the fact of being formed, for each of their sections, by a composite constituted by an outer skin resisting corrosions, an inner skin having substantially the same configuration as the outer skin and disposed parallel to and under the latter, and an insulating blanket or layer obtained by the injection, between the two skins, and then polymerization of a foam of a material which develops good qualities of fire resistance and adhesion to the skins.

The self-supporting structures thus obtained have the advantages of being aesthetic, rapidly and easily assembled, having excellent finish and quality and being capable of being produced within a very short period of time, the calculations pertaining to any metal framework being carried out in advance and permanent stocks being provided for all the sections of the insulating claddings.

From the point of view of conformity with standards and in particular guarantees determined by legislations or insurance companies, the constructions satisfying these new designs have the advantage of disconnecting the sealing constituent, i.e. the insulating cladding, which must be guaranteed for 10 years from the supporting constituent, i.e. the metal framework, which must be guaranteed for 30 years.

The considered designs therefore permit guaranteeing a longer life of the roofs by the individual replacement of the sections of defective cladding and reducing over a period of time the risks both for the manufacturer of all or a part of the self-supporting elements and for the owner of the roofed building, if he neglects maintenance.

However, the aforementioned constructions have three drawbacks:

Although they are almost completely eliminated, some thermal bridges remain in or between the framework and the cladding, which may result in some condensations when the occupants of the building do not renew the air for reasons of energy economy.

The manufacture of a blanket or layer of foam by injection between two skins whose lengths may reach 30 to 40 meters and whose developed widths may reach 3 to 4 meters , is always difficult to master and moreover requires heavy and costly tooling.

Above all, all the surfaces of a roof which are exposed to sunshine expand differently in the region of their skins, the outer skin, which is hotter than the inner skin, expanding more than the inner skin. For example, it has been measured that, in our latitude, in the middle of summer, for a self-supporting element 20 meters long, the differential expansion between the outer skin and the inner skin of any surface subjected to intense sunlight rapidly reaches at least 40 mm. This phenomenon has relatively little effect when it concerns planar self-supporting elements, even if the latter are of very great length. On the other hand, when it concerns self-supporting elements whose cross-section is in the shape of an arc of a circle or a V, this phenomenon of differential expansion between the two skins of the insulating cladding produces, on the surface of the outer skin, defects whose consequences are irreversible, even when the temperature of the roof drops and the two skins resume their original common length. These defects are due to the fact that, as soon as there is a differential expansion, the roof concerned becomes deformed and swells on the hotter side. Now, it is obvious that this swelling cannot occur without damage when the roof formed by juxtaposed elements in an arc of a circle or a V configuration, has a generally corrugated shape. In all its concave parts, in particular in the region of the edge of the dihedron of each element having a V-shaped crosssection, the swelling is naturally no longer possible. Under these circumstances, the outer skin deforms locally and this has for result to unstick it from the insulating layer and therefore to create a multitude of thermal bridges which, although infinitely small, reduce the insulating properties of each self-supporting element of the roof. Now, it should be borne in mind that roofs having a generally corrugated shape constituted by juxtaposed V-sectioned elements are those which are the most frequently requested by customers and installed, since they are more aesthetic and also offer the greatest possiblity of integrating therein all the technical functions indispensable to the activities within the protected building.

An object of the present invention is to provide a new type of self-supporting element which retains the advantages of known elements formed by the association of a metal framework and an insulating cladding and which this time, in the first place, permits a complete elimination of the thermal bridges and, in the second place, is easy and cheap to manufacture as concerns the insulating cladding, the component parts of the latter being indeed commercially available, and, in the third place, allows differential expansions between the most remote constituents of the insulating cladding.

The invention therefore provides a self-supporting element of great length for the construction for a roof of a building, and in particular an industrial, commercial, school, administration, sports building or a building for living quarters, said roof being formed by the combination of a plurality of these elements disposed parallel to one another and assembled along their longitudinal edges, said element being of the type formed by: (a) a framework of metal section elements extending continuously between the two longitudinal edges of the element and between its two transverse end edges so as to ensure the self-supporting character of said element, and (b) an insulating cladding detachably supported by said framework, wherein the cladding of said element is in a single unit and formed by a composite comprising an outer corrosion-resisting skin; an inner skin substantially of the same configuration as the outer skin and disposed parallel to and under the outer skin; and an insulating blanket constituted at least in part by fibres of mineral wool which extend substantially perpendicularly to the parallel planes of the skins and which are glued at their ends to the inside faces of said outer and inner skins, respectively.

In a preferred embodiment, the framework of metal section elements comprises three parallel tubular members which extend longitudinally and continuously between the two transverse end edges of the element, namely a tie-member disposed centrally in the longitudinal plane of symmetry of the element and two beams disposed laterally and each constituting a longitudinal edge of the element, and rafters which are disposed on each side of the tie-member and interconnect said tie-member and the two beams. The rafters which, on each slope of the framework, extend between the tie-member and the beams, are then inclined and disposed symmetrically with respect to the longitudinal plane of symmetry of the element. Advantageously, these rafters are disposed in a zig-zag fashion and inclined alternately toward the front and toward the rear of the element at a substantially constant angle relative to a cross-section of the element, the points of connection of each rafter with, respectively, the tie-member and the beam being common to the points of connection of the neighbouring rafters with, respectively, the tie-member and the beam.

The insulating single-unit cladding is supported exclusively by the two lateral beams of the framework. It is therefore essentially in the region of these sole lines of support of the cladding where any thermal bridge must be avoided.

The two skins of the single-unit insulating cladding are preferably of pre-lacquered aluminium sheet or aluminium alloy sheet, or otherwise of stainless steel, zinc, copper sheet or lead-coated sheet.

The advantage of aluminium over the other materials is due in large part to the fact that it is at present the only material delivered in sheets 2.50 meters wide so that one can avoid interconnecting two or more sheets by continuous longitudinal welds, as is required in the cases of the use of steel or other material the sheets of which are delivered at a maximum width of 1.60 meters.

The mineral wool fibres sandwiched between the skins in a direction perpendicular to the planes of the latter, are interconnected in layers, each one being of the type formed by strips disposed side by side and packed one against the other so as to have the required density, these strips being interconnected by connecting means disposed close to at least one of the surfaces of the layer. Layers of mineral wool fibres corresponding to this definition are disclosed in the European patent No. 79.100725.5/0 004,086 and are at present sold by the firms Pechiney and Composital under the name "Lamel R". The known advantages of this type of layers of mineral wool fibres disposed perpendicularly to the large surfaces are their high strength and thermal resistance and their high compressive strength.

However, as will be described hereinafter, a new advantage of this type of layers was found by the applicant of the present patent application when these layers are to be sandwiched between two metal sheets whose lengths exceed 20 meters and sometimes even reach 40 meters and more.

Advantageously, the layers of mineral wool fibres all extend in a substantially constant length and are separated from each other by transversely extending inserts arranged in accordance with a constant pitch between the two skins, each insert extending from one longitudinal edge to the other of the cladding and being formed by a block of foam of constant rectangular section, substantially at the centre of which a metal tube is embedded The function of these inserts is to absorb the shear stress and to avoid in this way the deformation of the inner skin.

In its most advantageous embodiment, the self-supporting element has, in cross section, a V shape whose axis of symmetry is vertical and passes through the longitudinal axis of the tie-member, the two wings of the V being each inclined to the horizontal at an angle of about 45°, the base of the V being rounded and having its concavity facing toward the ends of the wings. For the purpose of a simplified manufacture and assembly, the V is upwardly open, its rounded base then forming a gutter for the discharge of rain water.

To facilitate assembly between the self-supporting elements, and consequently the construction of the roof, each of the two lateral beams of the framework of any element is provided with means for rendering said element integral with a neighbouring, parallel, identical element. Advantageously, these connecting means comprise a fastener which is fixed in the facing longitudinal edge portions of the insulating claddings of each pair of interconnected elements. The fastener is then preferably fixed at the end of the insert so that the latter has for second function to participate in the connection of the cladding to the framework and to constitute a point whereby the roof element may be raised by means of an overhead crane or normal crane.

In its preferred embodiment, the outer skin of the insulating single-unit cladding has longitudinal ribs each of which extends continuously from one transvers end edge to the other of said cladding. This arrangement, in the same way as the use of layers of mineral wool fibres perpendicular to the skins, allows, for the first time, a differential expansion between the skins which is sufficient for an element of very great length. This advantage will moreover be considered in more detail hereinafter.

Integrated in each wing of the the cladding, between the two skins, are layers of wool fibres whose strips are interconnected by connecting means disposed close to the two surfaces of the layers. Moreover, integrated in the rounded base of the cladding there are, between the two skins, either layers of wool fibres whose strips are interconnected by connecting means disposed exclusively close to the surface of the layers which has the largest radius of curvature, or blankets bulging with rock wool, or blankets bulging with a foam of a material developing good qualities of adhesion and fire resistance, for example a foam of the polyurethane or phenolic type which is pure or contains fillers.

To avoid any thermal bridge between the framework and the cladding, each of the two longitudinal edge portions of the cladding is covered with a rubber sealing element having a U-shaped section whose branches cover the marginal portions of the outer sides of the outer and inner skins, the branch of the U-sectioned element which covers the marginal portion of the inner skin moreover bearing against a lateral beam, this sealing element extending continuously from one transverse end edge to the other of said cladding.

In a modification of the construction, the branch of the V which is the most oriented toward the North is provided with openings preferably in accordance with the pitch, or a multiple of the pitch, between two neighbouring inserts, said openings each being provided with a translucent skylight connected to the cladding by a peripheral sealing element whose two lip portions grip on the outer sides of the two skins and whose two other lip portions grip on the edge portions of the skylight.

Advantageously, a self-supporting element satisfying the aforementioned characteristics also comprises technical devices for the heating and/or the artificial lighting and/or the discharge of condensations, and/or the fire protection of the covered building.

In the region of the assembly line between two neighbouring elements, the cladding is completed with a ridge structure which overlaps a longitudinal edge portion of the first element and a longitudinal edge portion of the neighbouring second element, after its assembly with said first element, each ridge structure being made in a plurality of sections which are each fixed by clipping onto the uncovered branches of the U-section sealing elements fixed to the two facing longitudinal edge portions of the claddings of said elements.

At least one of the sections of the ridge structures may then be provided with means for ejecting it beyond a certain degree of heat.

It will be understood that a second object of the invention is to provide a building roof formed by the combination of a plurality of self-supporting elements satisfying the aforementioned characteristics, said elements being then disposed parallel to one another and assembled in pairs along their longitudinal edges.

For the purpose of more clearly explaining the present invention, there will now be described, as purely illustrative and non-limiting examples, preferred embodiments of the invention with reference to the accompanying drawings, in which.

Figure 1:
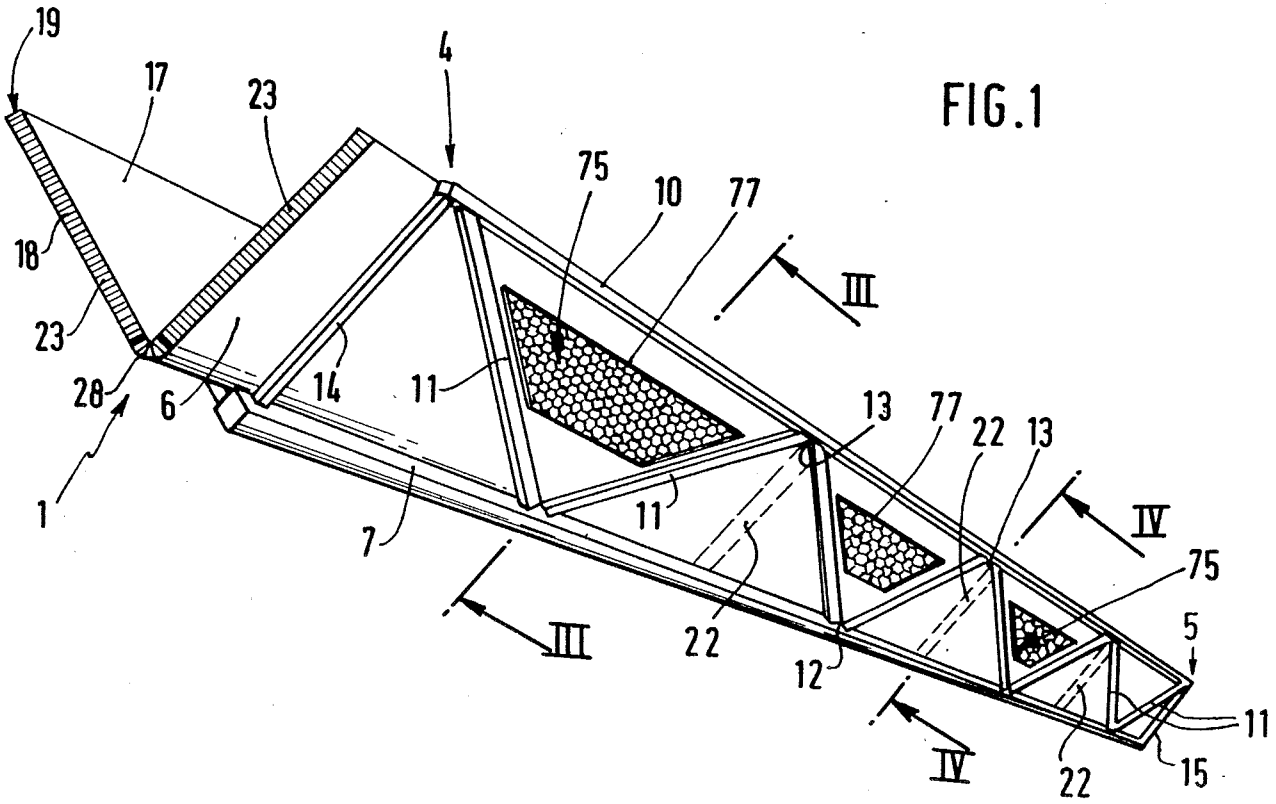
FIG. 1 is a perspective view of a self-supporting element according to the invention showing, from below, the metal framework which forms the cradle in which the insulating cladding is supported.
Figures 4, 5, 6:
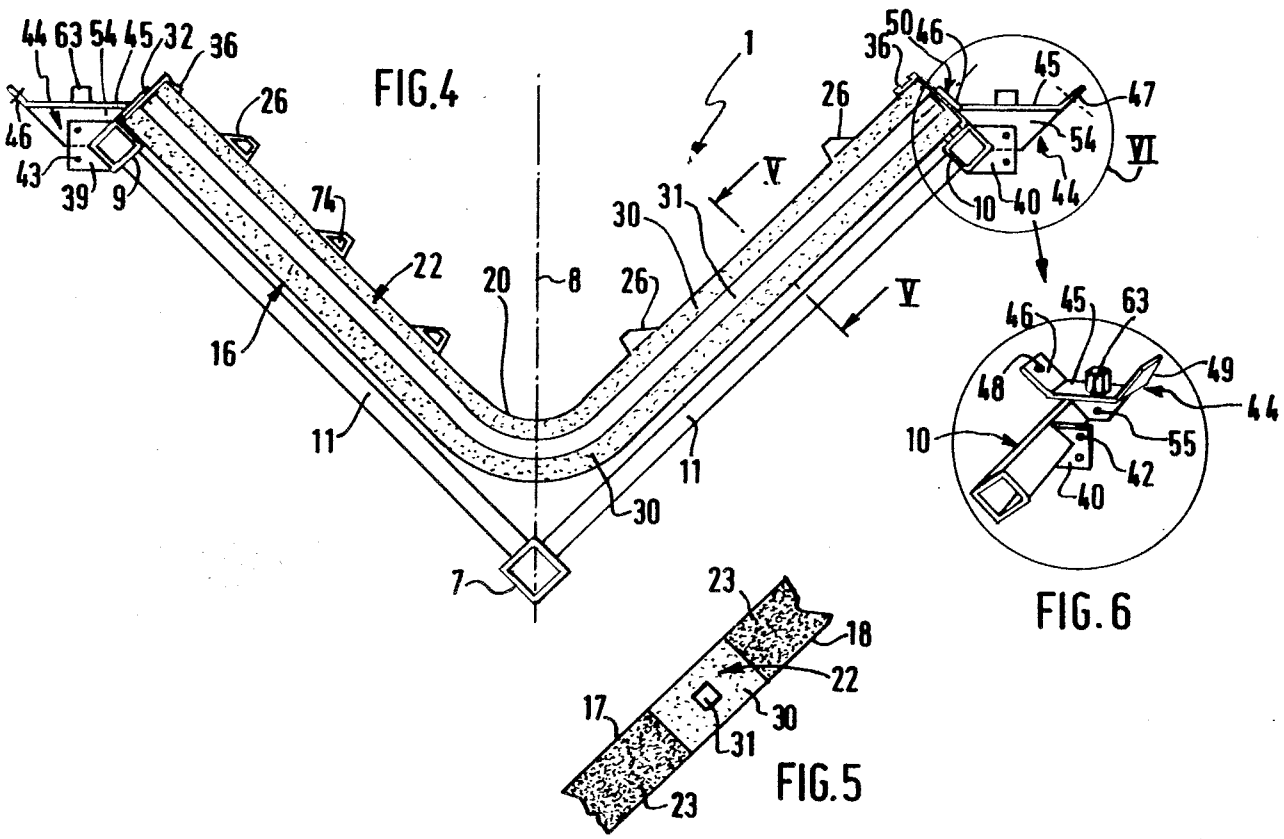
Figure 7A:
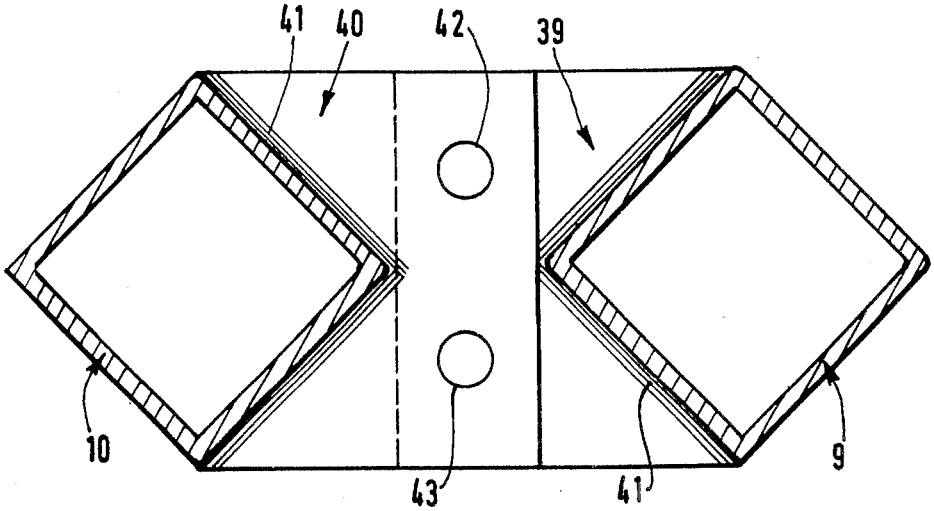
Figure 7B:
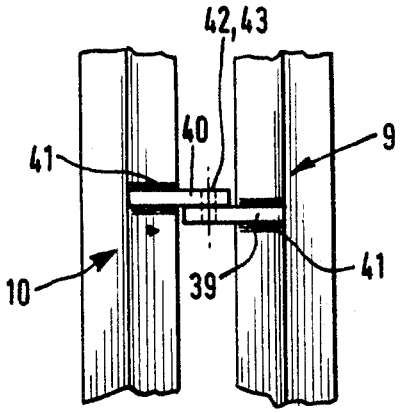

FIG. 4. is a cross-sectional view, taken on line IV—IV in the plane of an insert, of the self-supporting element of FIG. 1;

FIG. 5 is a longitudinal sectional view, taken on line V—V in one side of the insulating cladding, showing the detail of the insert;

FIG. 6 is a perspective view of the detail of the fastening between two neighbouring self-supporting elements disposed in the plane of each insert;

FIG. 7*a* is a front elevational detailed view of the members for combining two neighbouring self-supporting elements;

FIG 7*b* is a top plan view of a detail of the combination of two neighbouring self-supporting elements, employing the members of FIG. 7*a;*

Figure 8:
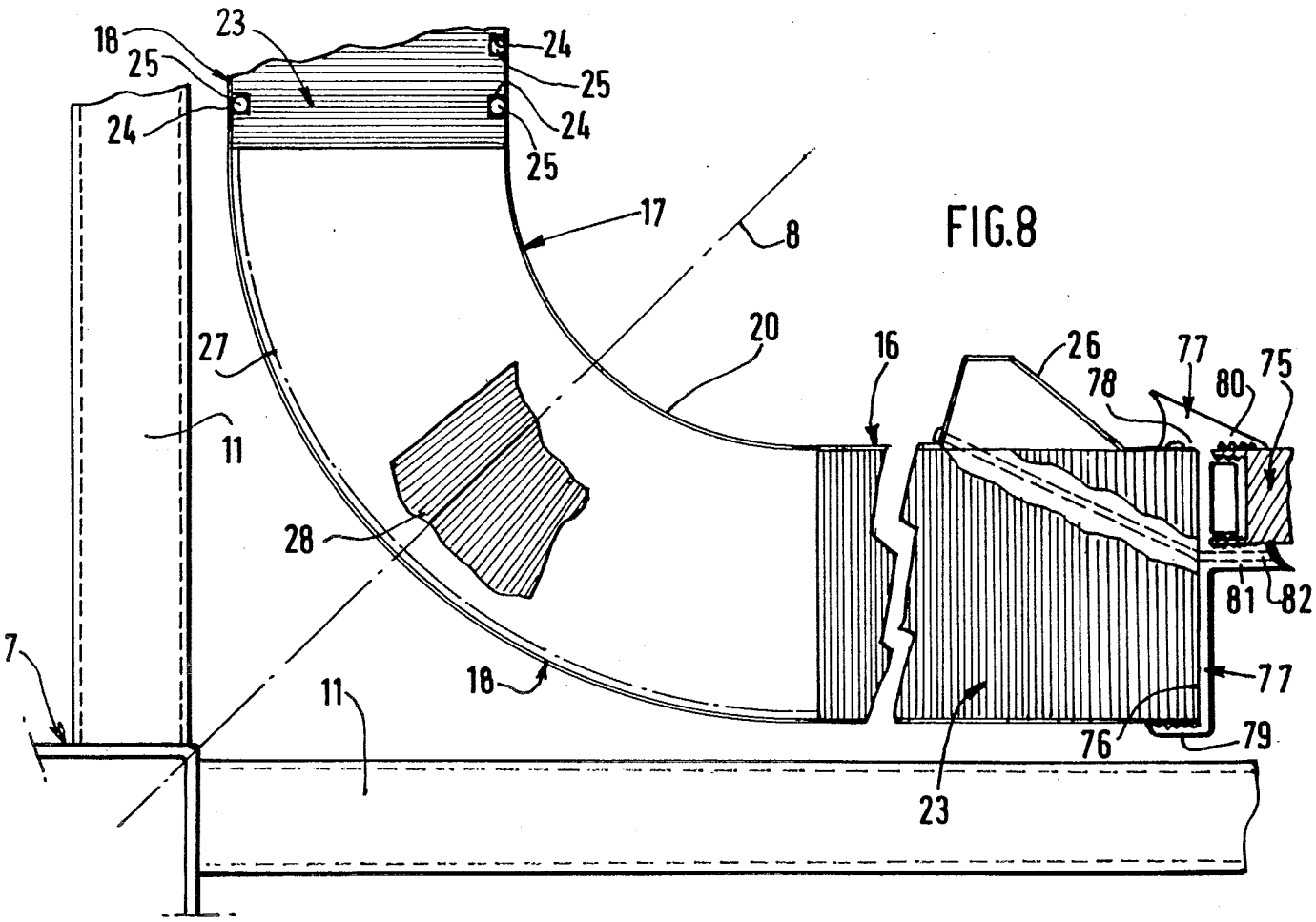
Figure 9:
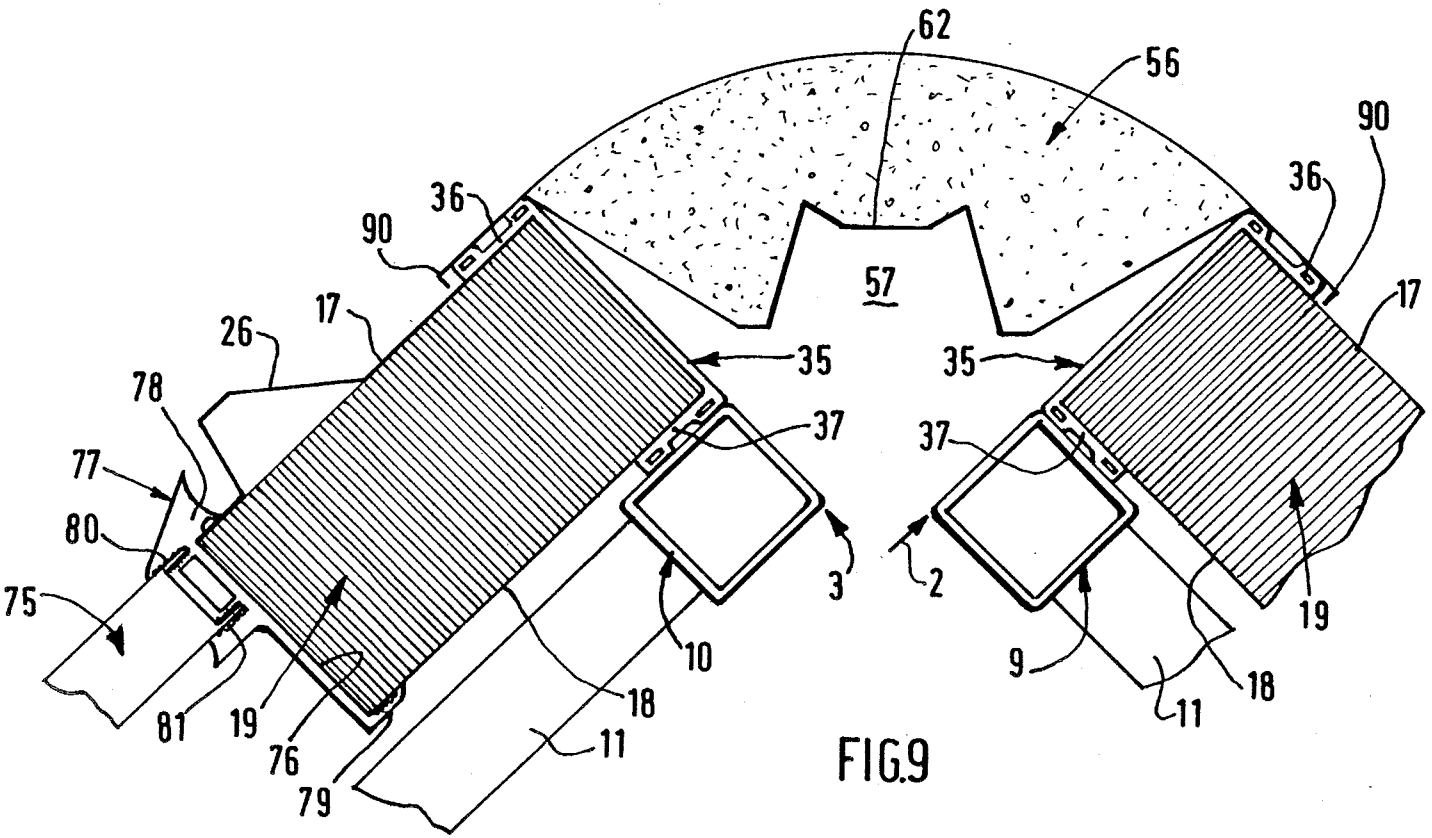
Figure 10:
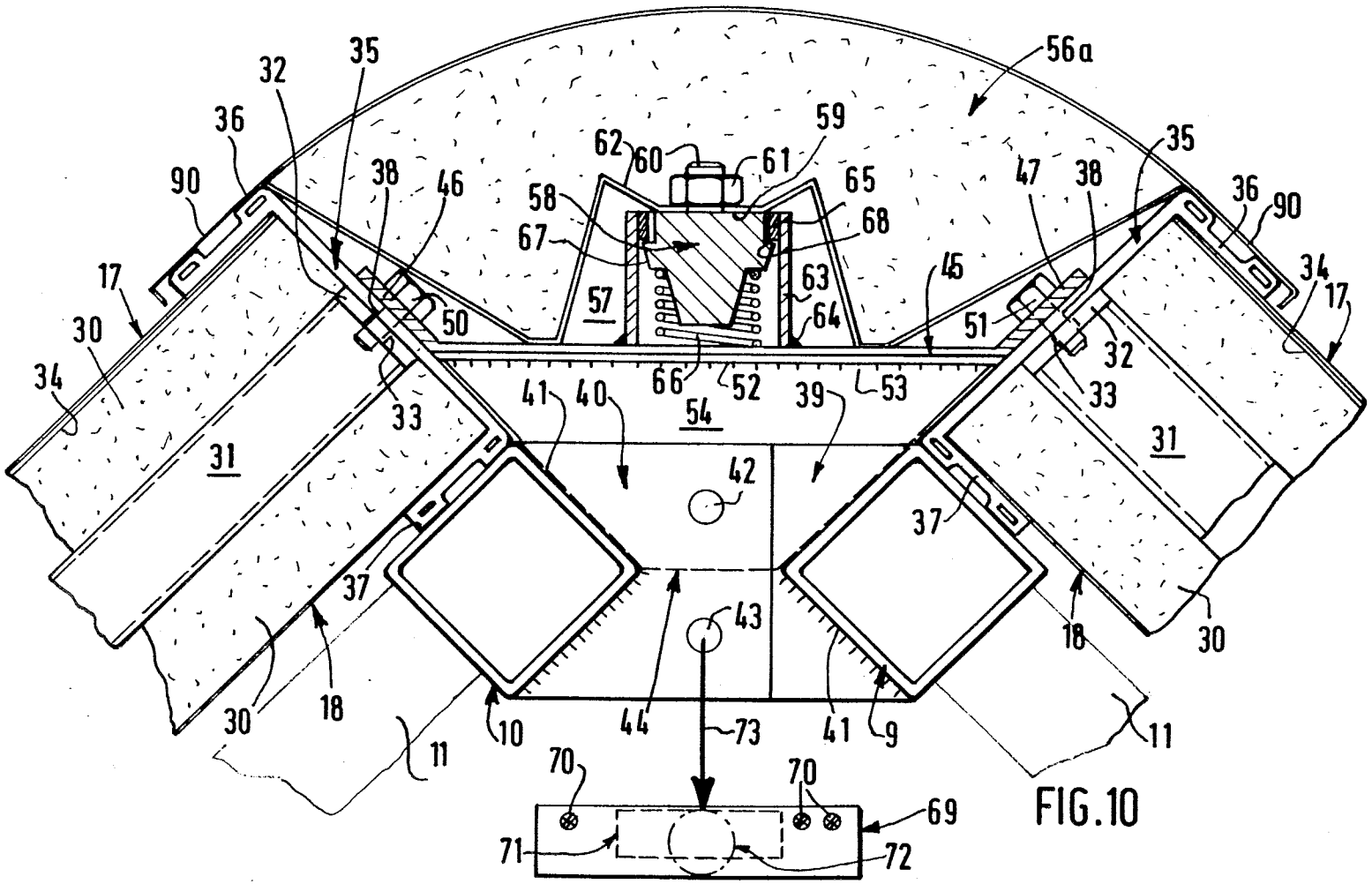
Figure 11:
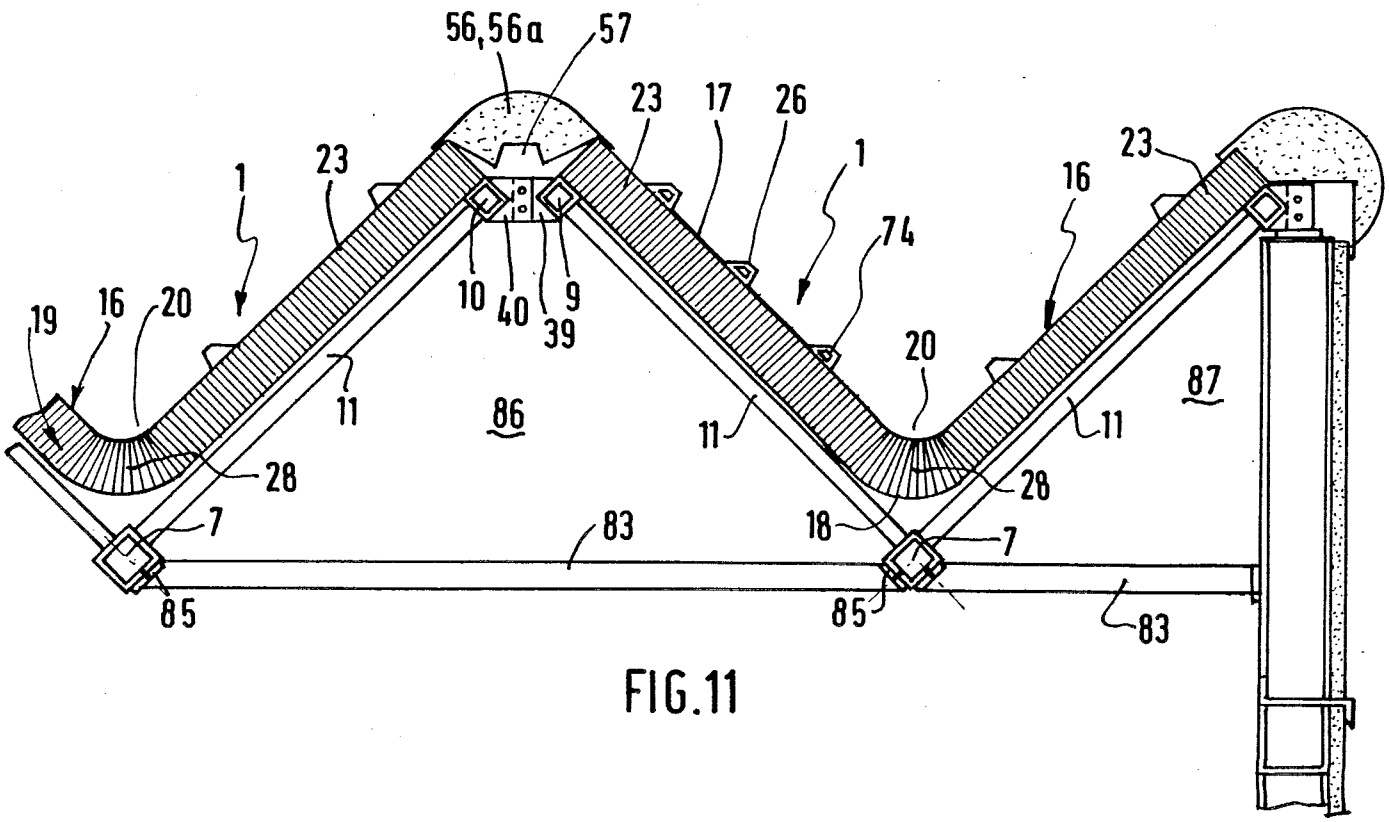
Figure 12:
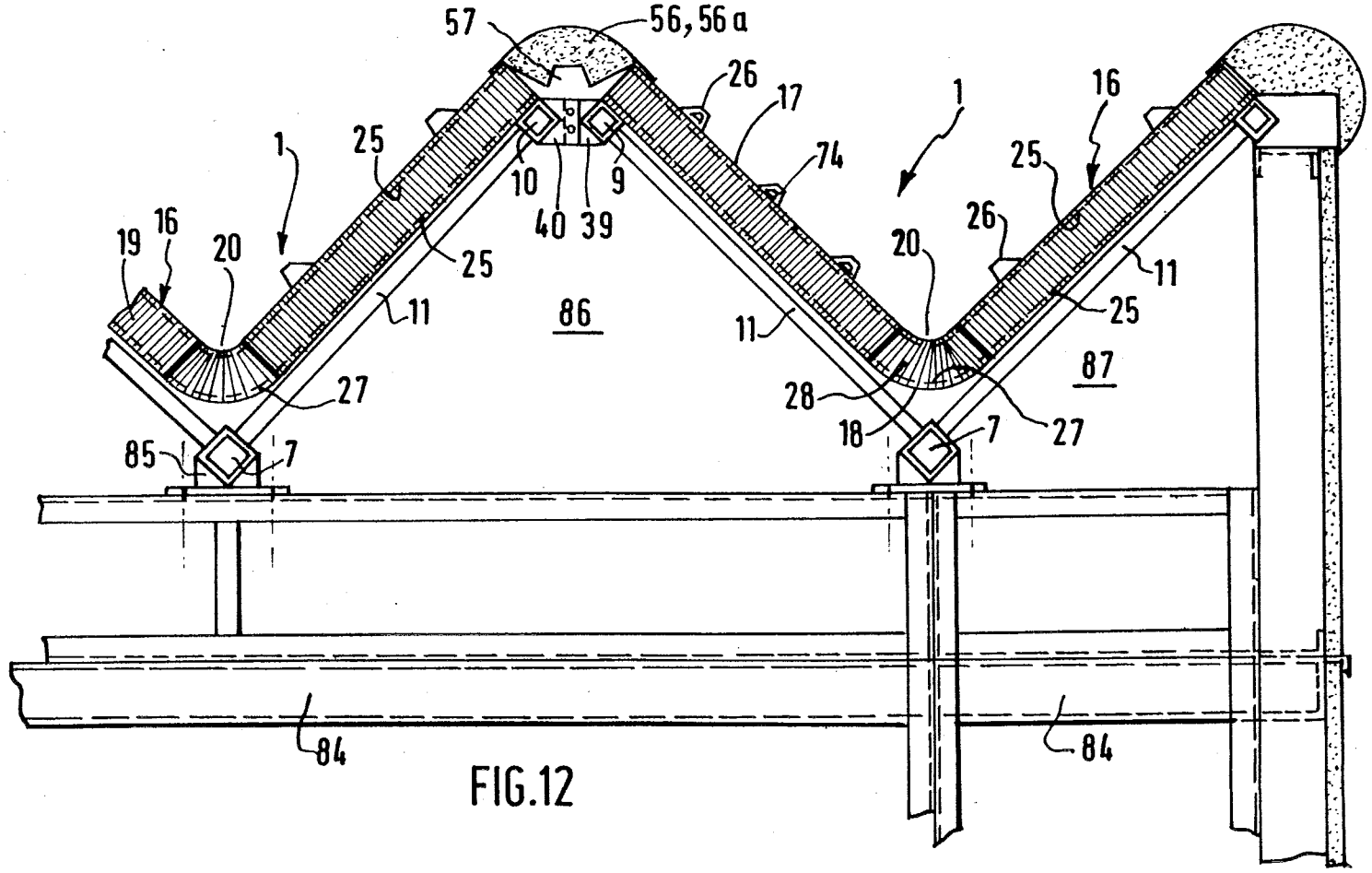

FIG. 8 is a cross-sectional view, taken on line III—III, of the detail of the lower part of the self-supporting element of the invention;

FIG. 9 is a cross-sectional view, taken on line III—III, of the detail of the upper part of the self-supporting part of the invention;

FIG. 10 is a cross-sectional view, taken on line IV—IV, of the detail of the upper part of the self-supporting element of the invention and the detail of a ridge structure section associated with a device permitting the upward propulsion of said section beyond a certain degree of heat in the environment of this device;

FIGS. 11 and 12 are cross-sectional views of two interconnected self-supporting elements mounted on a supporting structure of respectively a metal and concrete framework.

With reference to the drawings, the longitudinal self-supporting element of the invention is generally designated by the reference numeral 1.

The length of this element is between 5.40 and 45 meters, depending on the needs of the building to be installed, and for reasons of method of manufacture, this length will be advantageously a multiple of 1.80 meters.

In this respect, at least in France, the length of 21.60 meters will be one of the most common lengths since it moreover corresponds to the maximum "transportable length" authorized by the French highway legislation.

Throughout the following description, this value of 1.80 meters will constitute the "pitch" of the element 1 and will represent both its overall width subsequent to the assembly of the self-supporting element with neighbouring elements, and the distance longitudinally separating two successive components of an element which will be found throughout the length of the element 1 at this pitch.

In modifications, and as it is sometimes conventional in France, this pitch could be increased from 1.80 to 2.40 meters, or to any other value without the concept of the present invention being modified; the only dimensions which would then have to be modified would be the quasi-totality of the component parts of the self-supporting element 1, in particular the section elements of the metal framework whose dimensions in section would have to be increased in a ratio of at least 4/3.

In using the pitch of 1.80 meters, the element 1 has an overall height of 1 meter for the supporting metal framework, and an overall height of 1.20 meters for the framework covered with its complete insulating cladding, i.e. including th height of the ridge structure sections after they have been clipped in position along the assembly line between two neighbouring self-supporting elements.

The self-supporting character of this element 1 is afforded by a framework of metal section elements which extend continuously between the two longitudinal edges of the element 1, namely the left edge 2 and the right edge 3, and between its two transverse end edges, namely the front end edge 4 and the rear end edge 5, in such manner as to indeed ensure the self-supporting character whatever be the length of each element 1. In this definition of the transverse end edges of the framework, there has of course not been taken into account the hypothesis of a roof having one or two window roofs. For a roof having a window roof as shown by way of example in FIG. 1, the part of the cladding 6 extending beyond the transverse front edge 4 may reach a value if necessary of the pitch of 1.80 meters. By comparison, it should be noted that, at the present time, the standard projection 6 of commercially-available self-supporting roofs is 0.60 meter; the marked increase in the length of the window roof 6 in the practice of the invention is the simple consequence of the great lightness of the cladding carried by the framework.

The framework of metal section elements comprises:

(a) A tie-member 7 disposed centrally in the longitudinal plane of symmetry 8 of the element 1 and extending continuously between the two transverse end edges 4 and 5; this tie-member is tubular and, for constructing a self-supporting framework on a length of 21.60 meters, it will be for example produced from a 90 mm sided square section tube 5 mm thick so placed that one of its diagonal planes is contained in the plane of symmetry 8.

(b) Two identical beams disposed laterally and each constituting respectively a left edge 9 and a right edge 10 of the element 1; these two beams are parallel to the tie-member 7 and also extend continuously from the front transverse end edge 4 to the rear transverse end edge 5 of the element 1; the two beams 9 and 10 are tubular and, by way of example, for the construction of a self-supporting framework on a length of 21.60 meters, they will each be obtained from a 70 mm sided square section tube 4 mm thick; the two beams 9 and 10 are each disposed as the tie-member 7, i.e. one of their diagonal planes is parallel to the plane of symmetry 8.

(c) rafters 11 which are disposed on each side of the tie-member 7, symmetrically with respect to the plane of symmetry 8, and which interconnect the tie-member and the two beams 9 and 10; on each slope of the framework, the rafters are disposed in zig-zag fashion, i.e. they are inclined alternately toward the front end edge 4 and toward the rear end edge 5 of the element 1 at a substantially constant angle relative to a cross-section of the element; the points of connection 12 and 13 of each rafter 11 to respectively the tie-member 7 and a beam 9 or 10 are common to the points of connection of the neighbouring rafters to, respectively, the tie-member and the concerned beam, and they are advantageously achieved by welding; each rafter 11 is tubular and, for the construction of a self-supporting framework of a length of 21.60 meters, it will for example be obtained from a 50 mm sided square section tube 3 mm thick.

On each slope, in the region of the weld of the last tie-beam 11, the framework is completed by two tubular elements, namely a front tubular element 14 and a rear tubular element 15 both of which extend in a transverse plane and are also welded to the tie-member 7 and to the concerned left beam 9 or right beam 10.

Note that, owing to this rafter arrangement, the framework of metal section elements 7-9-10-11-14-15 is essentially symmetrical and balanced, namely symmetrical with respect to the vertical longitudinal plane 8, on one hand, and balanced from the front edge 4 to the rear edge 5 by the alternating inclination of the rafters on the other hand, so that the framework in this way has the double advantage of:

having the same characteristics of strength throughout its length, and having a right and a left slope which are absolutely identical, which correspondingly simplifies the assembly in the factory or on the site which, by convention, requires that the skylights be mounted on the slope the most exposed to the North; for this assembly there will be no need to pay particular attention to the left or right association of the cladding and the framework since the framework is symmetrical by construction.

The rafters 11, and to a lesser extent the end tubes 14 and 15, have for function to contribute to the selfsupporting characteristic of the framework and to eliminate the shear forces which are exerted transversely on the latter. The rafters must therefore be disposed along the three members 7-9-10 in sufficient number to ensure that these three members are rigidly assembled, that the parallelism therebetween is perfectly respected throughout the length of each element 1, and that consequently the self-supporting feature is guaranteed. In this respect, in the construction which appears to be the most interesting industrially, the rafters 11 are disposed in such manner that they each cover, on each slope of the framework, a length equal to one half of the pitch; in other words, the distance between two successive welds 12 or 13, respectively on the tie-member and on a beam, is equal to the pitch adopted for the construction.

Figure 3:
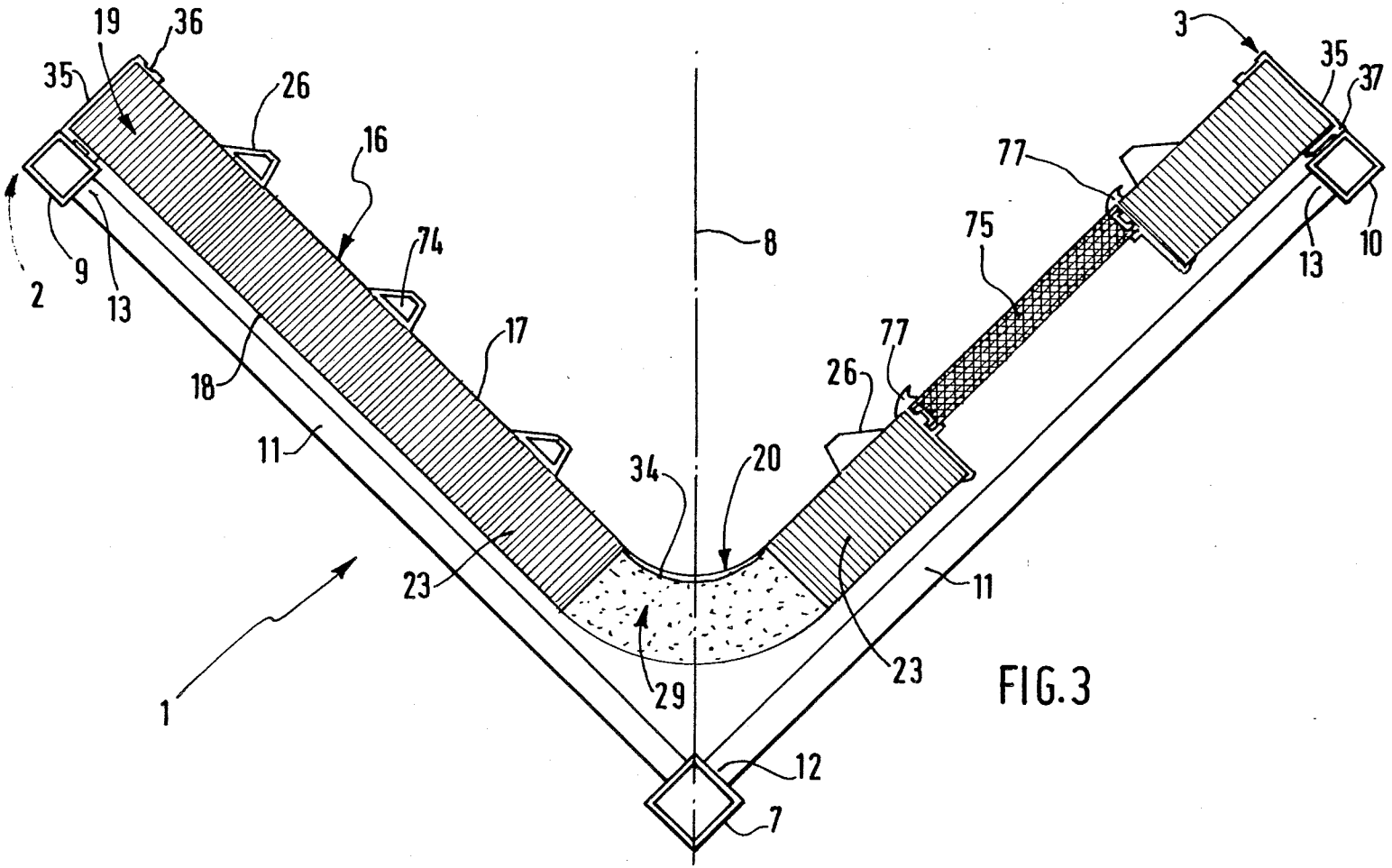
FIG. 3 is a cross-sectional view, taken on line III—III in the median plane of two neighbouring inserts, of the self-supporting element of FIG. 1.

Advantageously, the three members are disposed as shown in FIGS. 1, 3 and 4, namely the central tie-member 7 is in the lower position and the two lateral beams 9 and 10 are in the upper position.

Thus, after assembly, and when viewed in end elevation, the self-supporting element 1 has the shape of an upwardly open V whose plane of symmetry 8 is vertical and coincident with a diagonal plane of the tie-member 7.

The rafters 11, which are welded to a beam and to the tie-member, define on each side of the latter two planes termed "slopes" which are of course symmetrical with respect to the plane 8 and are inclined at about 45° to this plane 8 and to a horizontal plane.

In the foregoing construction, the tie-member 7 then constitutes the lower line of the framework and the lateral beams 9 and 10 the upper lines thereof.

With the dimensions previously given as examples for the tie-member 7, the beams 9 and 10 and the rafters 11, the framework constructed to be self-supporting over a length of at least 21.60 meters, with a pitch of 1.80 meters, is nontheless extremely light, since it weighs only 21 kg per square meter of ground projection. This configuration is sufficient to enable the framework to stand up to use in France in the most severe and most exposed regions, namely class (III) climatic regions for which roofs withstanding snow and wind are required.

Apart from its advantages of being self-supporting and of symmetry already explained, the framework of the invention, by the very fact of its lightness, affords two additional interesting features: its low cost as concerns manufacture and transport, and its ease of handling both when it is being manufactured and when it is transported or when it is mounted on top of the metallic structure 83 or concrete structure 84 which will support the roof.

In the cradle formed by the defined framework there is integrated an insulating single-unit cladding 16 manufactured separately.

In order to be both insulating, resistant to atmospheric attack and as light as possible, the cladding 16 is a composite formed by an outer skin 17 resistant to corrosions, an inner skin 18 substantially of the same configuration as the outer skin 17 and disposed parallel to and below the latter, and an insulating blanket 19 formed at least in part by mineral wool fibres which extend in a directon perpendicular to the parallel planes of the skins.

The outer and inner skins are for example of aluminium sheet, preferably pre-lacquered aluminium or aluminium alloy, or any other material resisting saline mist, corrosive atmospheric environments and sandstorms and any other aggressive atmospheric phenomenon.

The choice of aluminium sheets is however advisable inasmuch as aluminium is up to the present time the only material manufactured and sold in sheets which may be as much as 2.50 meters wide. The other materials, such as stainless steel, are sold only in sheets up to at the most 1.60 meters wide. Now, in the aforementioned construction, the widest skin, namely the inner skin 18, reaches a developed width of 2.20 meters. The use of aluminium sheets thus avoids any longitudinal joint or weld on the surface of the skins 17 and 18.

For the framework construction already given by way of example, the outer skin 17 will be for example pre-lacquered aluminium sheet 7/10 mm thick and the inner skin 18 will be for example an aluminium sheet having an acrylic coating 5/10 mm thick. Such an inner skin will also serve as an absolute vapour barrier.

In order to bear and be perfectly maintained in its cradle of metal section elements, the cladding 16 also has an upwardly open V section, the two sides of this V making therebetween an angle of 90°. The skins 17 and 18 are consequently folded in the middle thereof so as to form at the base of the cladding a curved portion 20 whose concavity faces the ends of the wings of the V.

The insulating blanket 19 sandwiched between the outer skin and the inner skin 18 is, at least in the whole of the two orthogonal segments of the V, formed by mineral wool fibres which extend in a direction perpendicular to the planes 17 and 18, as previously defined.

Figure 2:
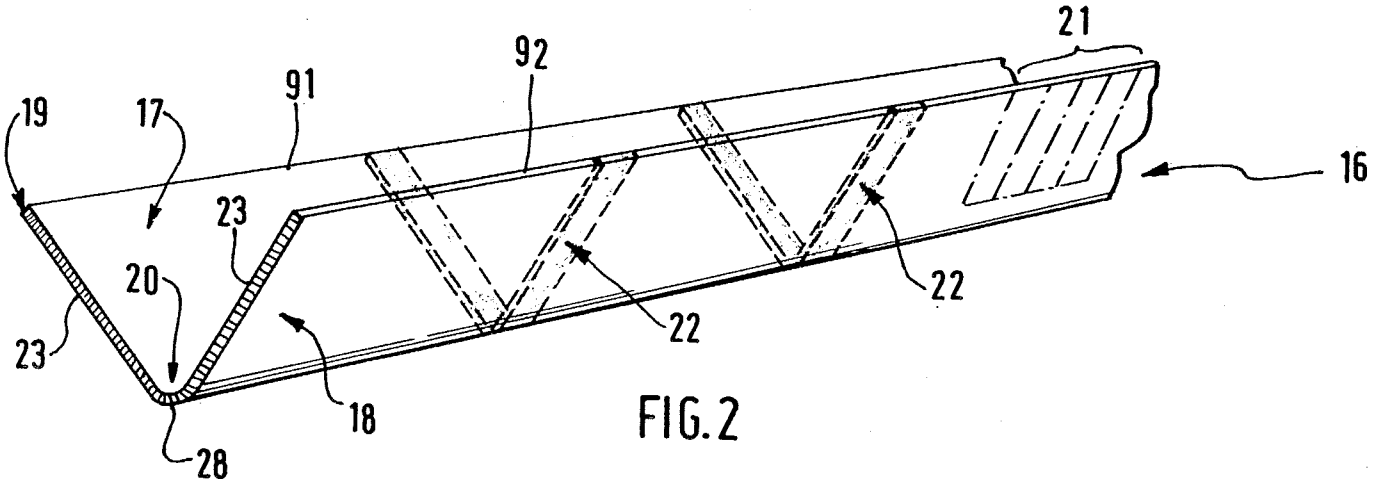
FIG. 2 is another perspective view of the insulating cladding shown outside its cradle.

Preferably, this type of blanket 19 is then formed by layers, each of which is of the type formed by strips 21 disposed side by side and stacked against each other so as to have the required density, such as represented at 21 in dot-dash lines in the right part of FIG. 2.

These strips 21 will have been obtained by transverse cutting out from a sheet of conventional glass wool, i.e. a wool having fibres parallel to the two surfaces of the sheet. After cutting out, the strips 21 are all turned through 90° about a longitudinal line and then juxtaposed and stacked against each other to give to the new sheet then formed of fibres perpendicular to its two large sides, the required density. By means of circular saws, parallel recesses extending transversely of the longitudinal direction of the strips 21 are cut in the entire length of the new sheet, in at least one of its large surfaces. Continuous connecting elements, for example simple lengths of string, are then placed in the parallel recesses and adhered to the bottom of the latter so as to interconnect the strips and form an undeformable insulating panel having the required density of compactness.

The method of manufacturing these sheets of mineral wool fibres perpendicular to the large surfaces is well known and it does not seem to be necessary to explain it further. Such sheets are moreover commercially available under the name "Lamel R". For further information concerning the manufacture of these sheets, reference may however be made to the European patent No. 79.100725.5/0.004.086.

To construct the roof chosen by way of example for the present invention, the sheets of mineral wool sandwiched between the skins 17 and 18 will be sheets 120 mm thick, whose length will be cut to the value of the pitch minus the width of the inserts 22 and cut to the width of 0.90 meter.

The layers of glass wool thus obtained are thus placed between the two skins completely along the two sides of the cladding and adhered to the skins by the points of all the fibres which are perpendicular to said skins. For this purpose, the inner surfaces of the outer skin 17 and inner skin 18 are previously coated with adhesive throughout their area so that the layers adhere well to the skins and the adhesion is homogeneous. The layers 23 of mineral wool fibres sandwiched in this way between the skins 17 and 18 then have their recesses 24 and their connecting cords 25 which extend in the longitudinal direction of the cladding. The advantage of the arrangement of the mineral wool fibres perpendicular to the skins 17 and 18 is that said skins are then mounted relative to each other, as it were, on independent "needles", which clearly allows the desired differential expansion between the skins 17 and 18. Depending on the value of this differential expansion between the outer skin 17 and inner skin 18, the glass wool fibres will be somewhat inclined with respect to each other without causing the unsticking of their points. With this arrangement, the possibility of thermal bridges within the insulation sandwich of the cladding is completely eliminated.

Further, in order to ensure that the force of the expansion is exerted throughout the length of the cladding, longitudinal ribs 26 are provided in projecting relation to the outer skin 17. These ribs 26 are for example three in number and equally spaced apart on the blind slope of the cladding which, at the moment of mounting, will be the most exposed to the South while they are only two in number on the other slope of the cladding which will be the most exposed to the North and provided with skylights 75.

Owing to this combination of layers 23 of glass wool and longitudinal ribs 26, the transverse expansions of the outer skin, with respect to the inner skin, are absorbed by the ribs 26 and the differential longitudinal expansions are transmitted through the ribs 26 throughout the length of the cladding and are absorbed by the sheets 23.

In the rounded base 20 of the cladding, the insulating blanket 19 which completes the lateral layers 23 is formed:

by layers of mineral wool fibres which extend also in a direction perpendicular to the parallel planes of the skins 17 and 18, said layers being then formed by strips obtained in accordance with the process already described and interconnected by connecting elements 27 disposed exclusively close to the surface of the layers which has the largest radius of curvature, i.e. close to the inner skin 18, as shown in FIG. 8; in this modification, the sheets 28, which are then flexible and composed of mineral wool fibres, are cut to the length of 60 cm and to the width of the pitch of 1.80 meters minus the width of the inserts 22; the sheets 28 are therefore rendered concave and are disposed transversely at the bottom of the cladding relative to the general longitudinal direction of the latter. The points of all the fibres of these sheets 28 are also adhered to the inner surfaces of the two skins 17 and 18; owing to the curved shape of the layers 28, there is obtained in this way a packing of their component strips adjacent to the outer skin 17;

or by convex curved blankets of rock wool adhered to the inner surfaces of the two skins 17 and 18;

or by blankets 29 of polyurethane or phenolic foam which is pure or contains fillers, said blankets shown in FIG. 3 being solely adhered to the inner surface of the skin 18 and to the outer skin so as to avoid opposing the expansion phenomenon; the density of such blankets 29 will be on the order of 0.40.

In all the aforementioned embodiments, the coefficient of insulation K of the cladding in the horizontal position is on the order of 0.30 to 0.33.

The aforementioned cladding configuration consequently has many advantages over traditional constructions: the thermal bridges are completely eliminated; the differential expansion phenomenon no longer have any negative effect on the life of the cladding; the insulation is maximum; and the tensile and compressive strengths are markedly improved.

In order to absorb the shear forces and avoid the deformation of its inner skin 18, the cladding is moreover provided with rigid inserts 22 disposed transversely at the pitch of 1.80 meters throughout the length of the cladding.

These inserts 22 are formed for example by a block 30 of rigid foam, for example polyurethane foam, of constant rectangular section, substantially in the centre of which there is embedded a metal tube 31 of aluminium or steel, for example a square tube having a 40 mm side dimension and a thickness of 3 mm .

Each insert 22 extends from the left longitudinal edge 91 to the right longitudinal edge 92 of the cladding. The inserts 22 therefore separate the glass wool layers 23 in the same way as they separate the curved sections 29 of polyurethane foam blanket or the convex curved sections of rock wool blanket, or the sections of flexible glass wool sheets 28.

The inserts 22 constitute the most rigid elements of the insulating cladding 16; they are also provided for constituting the points of the fixing of the cladding to the framework of metal section elements. For this purpose, each right and left end of the tube 31 embedded in the foam block 30 is closed by a square plate 32 in the centre of which a tapped hole 33 is provided.

In order to avoid opposing the differential expansions of the outer skin relative to the inner skin, the inserts 22 are only adhered to the inner surface of the inner skin and there is no connection with the inner surface of the outer skin. It is known that, when constructing the sandwich of the insulating cladding 16, all the surfaces of the inner sides of the outer and inner skins had been coated with an adhesive. In order to ensure that the inserts 22, and possibly the curved sections 29, do not adhere to the outer skin, all the surfaces of the inserts 22 and the sections 29 facing said outer skin are therefore protected by siliconed sheets 34. Lastly, the insulating cladding 16 is closed along its two transverse end edges and along its two longitudinal edges by sealing elements 35 of rubber, for example neoprene, having a U-shaped cross-section. The wings 36 and 37 of these sealing elements 35 also have a U shape, the concavity of which faces away from the cladding. These wings 36 and 37 cover the marginal portions of the outer surfaces of the outer skin 17 and the inner skin 18. The webs of the two sealing elements 35 which cover the longitudinal edges of the cladding are provided with orifices 38 facing each tapped hole 33 provided in the plate 32 which closes each end of a tube 31.

In the same interest of perenneality of the other principal component of the self-supporting element 1, all the metal section elements of the supporting framework are advantageously painted on their outer surface and closed so as to avoid any internal oxidation.

When combining the insulating cladding 16 with its cradle of metal section elements, the visible orifices 38 in the sealing elements 35 are placed in alignment with the connecting points 13 of the rafters to the two beams.

Provided in front of each of these points 13 on each beam 9 and 10 is a sheet 39 and 40 respectively, jointed at 90° and welded at 41 by its jointed part to the two projecting sides of the beam 9 or 10.

These sheets 39 and 40 form means for connecting a selfsupporting element 1 to another identical neighbouring parallel element.

Each sheet 39 or 40 is therefore provided in the part thereof projecting from the beam with two vertically aligned orifices 42 and 43.

When the self-supporting elements 1, which moreover bear by their front and rear ends on the superstructure, are disposed in parallel and side by side relation so that the two upper orifices 42 and the two lower orifices 43 of all the sheets 39 and 40 coincide, the elements are fixed together by bolting.

Two self-supporting elements 1 are therefore interconnected exclusively by these fixing means which are repeated at the pitch of 1.80 meters in the upper part of these elements, along each beam 9 and 10, with no drilling of the latter.

In each metal framework, the insulating cladding 16 bears exclusively on the two lateral beams 9 and 10 by the wings 37 of its sealing elements 35 which cover the right and left marginal portions of the inner skin 18. In order to avoid any thermal bridge, the sealing elements 35 therefore extend continuously from one transverse end edge to the other of the cladding.

The fixing of the cladding to the framework which receives it employs the means 39–40 for connecting one element to a neighbouring element.

For this purpose, members 44 are used which are disposed at the pitch of 1.80 meters vertically above the sheets 39 and 40.

Each fastening member 44 is formed by a horizontal sheet 45 bent at 45° at 46 and 47 on each of its two ends. Each raised edge portion of this sheet 45 covers a part of the web of a sealing element 35 so as to correspond at least to the surface of the closing plate 32 of the tube 31.

Further, each raised edge portion, respectively 46 and 47, is provided with an opening, respectively 48 and 49, for the passage of a bolt, respectively 50 and 51, whose shank extends through the opening of the raised edge portion which was provided in facing relation to the opening 38 of the sealing element 35 and then extends through the opening 38 and is screwed in the tapped hole 33 of the plate 32.

Welded under the lower side 52 of the web of the sheet 45 along the line 53 is a plate 54 of trapezoidal shape having edges which converge away from the sheet 45. These convergent edges are spaced from the planes formed on each of the two longitudinal edges 2,3 of the element by the web of the sealing element 35 in alignment with the outer upper surface of a beam 9 or 10.

In its lower central part, the plate 54 is provided with an opening 55 in alignment with the upper openings 42 of the two connecting sheets 39 and 40. The fastening member 44 may therefore be fastened to the sheets 39 and 40 by the same bolting as that extending through the openings 42.

All the operations for interconnecting the self-supporting elements 1 and the operations for connecting the insulating cladding to the supporting framework may thus be carried out from above the roof so that it is possible to avoid the construction of scaffolding and the addition of safety protections inside the building to be roofed. A fitter placed in position upright in the rounded bottom of the cladding in vertical alignment with an insert 22, is indeed at a distance of less than 50 cm from the component parts 39, 40 and 44 and can consequently carry out without difficulty the specified bolting operations in the openings 43, 42 and 33.

After the mounting of the self-supporting elements 1 and the interconnection of these elements and the connection of the insulating claddings on the self-supporting frameworks, the claddings are completed by ridge structures which cover a longitudinal edge 2 of a first element and the longitudinal edge 3 of a neighbouring second element after it has been assembled with said first element.

Each ridge structure is made in a plurality of sections 56 of curved shape with its concavity facing downwardly, each of said sections being fixed by clipping to the uncovered wings 36 of the U-section sealing elements 35 fixed to the two longitudinal edge portions 91 and 92 in confronting relation to said elements.

Advantageously, each ridge structure section 56 is made from polyurethane foam, since the differential expansions to which each section will be subjected cannot this time result in a hindrance, first of all owing to the upwardly convex curved shape of each section, secondly owing to its clipping onto the cladding, and lastly owing to the fact that the sections may be provided with a small dimension, for example a length of 1.80 meters or 3.60 meters.

Some of these ridge structure sections, and even all of them, may be provided with a device which automatically ejects them to the exterior in the event of a fire in the building.

Each specific fire safety section **56*a*, such as that shown in FIG. 10, is provided, in the bottom of its cavity 57 facing the fastening member 44, with a dome 58 whose base 59 is extended by a screwthreaded stem 60 which is screwed into a nut 61 embedded in the section 56*a* in the bottom 62 of its cavity 57**.

In addition, the upper surface of the sheet 45 of the fastening member 44 is provided with a cylindrical collar 63 welded by a weld bead 64. A circular elastically yieldable sealing element 65 is adhered to the interior of said collar in the upper part of the latter. This sealing element 65 is made from a material which melts beyond a certain degree of heat satisfying safety standards.

Before clipping this specific section 56a in position, the fitter places a compression coil spring 66 in the bottom of the collar 63.

At the same time as the section 56a is clipped by its end wings 90 onto the wings 36 of the two facing sealing elements 35, the dome 58 enters the collar 6, by taking advantage of the elasticity of the sealing element 65 and the taper of a projection 67, and compresses the spring 66 and becomes jammed under the sealing element 65 by the upper circular edge 68 of the projection 67 so as to bear against the under side of the sealing element 65.

In the event of a fire inside the roofed building, as soon as the surrounding temperature of the sealing element 65 reaches the degree of heat which results in the melting of this sealing element, the latter is no longer able to retain the dome 58 by its projection 67 and the spring 66 automatically ejects the section 56a outwardly so that the smoke can escape.

The self-supporting element 1 of the invention may also include technical devices for ensuring the heating and/or the artificial and natural lighting and/or the discharge of condensations and/or the fire protection of the roofed building.

The boltings 43 can be used for this purpose for the fastening of a duct 69 for receiving the lighting tubes 70; a sprinkler 71 sprinkling water into the building in the event of flames; and a pipe 72 for the circulation of a heating fluid for the building. These technical devices have been diagrammatically shown in FIG. 10, the arrow 73 representing the means for hooking the duct 69 shown in full lines, the sprinkler 71 shown in dotted lines, or the pipe 72 shown in dot-dash lines.

For heating the building, there may also be provided solar sensors 74 under the longitudinal ribs 26 which extend continuously from the front transverse end edge to the rear transverse end edge of the cladding Each of these sensors 74 will then have advantageously a shape homothetic to that of the ribs 26 so as to occupy the maximum amount of the free volume under these ribs between the outer skin 17 and the upper side of the layers of mineral wool 23 alternating with the upper surface of the polyurethane foam blocks 30 of the inserts 22.

In the optional case where the client desires to light his building in a natural manner, an insulating cladding provided with translucent skylights 75 on one of its sloping sides will be manufactured in the factory for this client. Each of these skylights will advantageously have a trapezoidal shape so as to be capable of being integrated between two rafters 11. These skylights will be provided at intervals of 1.80 meters or at intervals which are a multiple of this pitch.

In order to avoid weakening the mechanical characteristics of the insulating cladding 16, it will be clear that the position of the skylights will be such that it will never require the partial cutting away of the inserts 22. The skylights 75 will therefore always be arranged to be integrated between two rafters which diverge toward the beam, which amounts to constructing trapezoidal skylights whose small sides converge toward the rounded bottom 20 of the insulating cladding 16.

The outer skin 17, the inner skin 18 and the layers 23 will be cut-away before the realization of the sandwich so as to leave on a sloping side of the cladding 16 openings 76 whose shape is congruent with that of each skylight.

In the factory, each opening 76 will receive on its periphery a sealing element 77 of rubber, for example neoprene rubber, whose two lip portions 78 and 79 grip the outer surfaces of the two skins 17 and 18 and whose other two lip portions 80 and 81 grip the edge portions of the translucent skylight 75.

There may be provided in the lip portion 81 the starting end of a tube 82 which extends through a layer 23 and opens out through the outer skin 17 and permits the discharge of possible condensations.

In the hypothesis of an insulating cladding 16 provided on one of its sloping sides with skylights 75 the ribs 26, which will then be two in number, will border the line of the skylights respectively along their large bases and small bases.

When mounting, the cladding 16 will be placed in its cradle of metal section elements 7, 9, 10, 11, 14, 15 so that the sloping side provided with said skylights will be the sloping side the most oriented toward the North. Sunrays inclined at 70° will then be unable to pass through the cladding elements constituting the roof after assembly.

Further, upon mounting, there will be given to each self-supporting element 1 a slope of between 2% and 5% required for a good flow of rainwater along the gutter which the rounded bottom 20 of the insulating cladding 16 will then form. This slope may be obtained:

either by a difference of level between the two lines of supports 85 of the metal carrying structure 83 or concrete carrying structure 84 which receive the respectively front and rear ends of the tie 7;

or, if the two supports 83 or 84 are at the same level, by the use of packing blocks of suitable heights interposed between one of said two supports and a line of supports 85.

Traditionally, the isosceles triangular openings 86 or 87 existing at the two ends of each element 1 mounted on the superstructure will be closed by end sheets termed tympani mounted either on the bracing metal bars 83 or on the concrete framework.

As concerns the hoisting of the frameworks and the claddings immediately after their manufacture for storing or transporting them, it will be more advantageously carried out by using respectively the sheets 39, 40 and their openings 42, 43 which permit the hooking of slings, the inserts 22 and their end plates 32 provided with openings at 33 in which may be temporarily fixed the screwthreaded rods of anchoring rings.

Whether each cladding be placed in its framework in the factory or, after transport, only on the building site, said cladding will be in these two cases, immediately after it has been well placed in position, fixed to its supports 9 and 10 by means of the fastening members 44 bolted in the openings 42. On the building site, the connection of the cladding in its framework will therefore always be the case before the hoisting of each self-supporting element; in this way the cladding will be stable when mounting since it will be hoisted by means of its supports in the self-supporting framework.

After the hoisting and mounting of the complete selfsupporting elements on their receiving superstructure 83 or 84, the fastener members 42 of each cladding on its framework will be taken apart one by one and immediately after reassembled moreover at the same time as the concerned framework will be associated by bolting at 42 and 43 with its neighbouring framework.

For the maintenance of the outside of the roof, it will be more convenient to operate by mounting always on the roof from the exterior and moving along the roof with precaution so as to avoid damaging the outer skin 17.

For the maintenance of the inside of the roof, including the changing and the mounting of new skylights 75 or new technical devices 69–72, it will be convenient to provide hooking points for fixed or mobile ladders or platforms on the metal framework and preferably on the tie-member 7.

It must be understood that the scope of the invention is not intended to be limited to the mentioned modes of application or the embodiments, as various modifications may be envisaged without departing from the scope of the invention defined in the appended claims.

Further, it will be clear that this scope of the invention also encompasses the roof obtained by the assembly of a plurality of the self-supporting elements 1 which are disposed parallel to one another and combined along their longitudinal edges, and also the two main components which permit the construction of the self-supporting element of the present invention, namely the framework of metal section elements and the single-unit insulating cladding.

I claim:

1. A self-supporting element of great length for the construction of a roof of a building, in particular an industrial, commercial, school, administration or sports building, or a building for living quarters, said roof being formed by the combination of a plurality of said elements which are disposed parallel to each other and assembled along longitudinal edges thereof, said element having two longitudinal edges, a front transverse end edge, a rear transverse end edge and a longitudinal plane of symmetry and comprising:

(a) a framework of metal section members extending continuously between said two longitudinal edges and between said two transverse end edges so as to ensure a selfsupporting character of said element, and (b) an insulating cladding detachably supported by said framework, said cladding being in a single unit and formed by a composite comprising: an outer skin resisting corrosions, an inner skin substantially of the same configuration as the outer skin and disposed parallel to and under the outer skin; and an insulating blanket comprising at least partly mineral wool fibres which extend in a direction substantially perpendicular to parallel planes of the skins and which are glued at their ends to the inside faces of said outer and inner skins, respectively.

2. A self-supporting element according to claim 1, wherein said framework of metal section members comprises three parallel tubular members which extend longitudinally and continuously between said two transverse end edges, namely a tie-member disposed centrally in said longitudinal plane of symmetry of the element and two beams disposed laterally and each defining one of said longitudinal edges of the element, and rafters which are disposed on each side of the tie-member and interconnect the tie-member and the two beams.

3. A self-supporting element according to claim 2, wherein the element has two sloping sides and the rafters which extend on each sloping side of the framework between the tie-member and the respective beam, are inclined and symmetrically disposed with respect to said longitudinal plane of symmetry of the element.

4. A self-supporting element according to claim 2, wherein the rafters are disposed in a zig-zag fashion, are alternately inclined toward the front end edge and toward the rear end edge of the element substantially at a constant angle relative to a cross-section of the element, and are connected to the tie-member and the respective beam at points common to points of connection of neighbouring rafters to the tie-member and the respective beam.

5. A self-supporting element according to claim 2, wherein the single-unit insulating cladding is supported exclusively by the two lateral beams of the framework.

6. A self-supporting element according to claim 1, wherein the wool fibres are interconnected in layers, each layer being formed by strips disposed in side-by-side relation and packed one against the other so as to achieve a required density, connecting elements interconnecting the strips and disposed close to at least one surface of the layer.

7. A self-supporting element according to claim 6, further comprising inserts disposed transversely at a constant pitch between the two skins, the layers of wool fibres being of substantially constant length and separated from each other by the inserts, each insert extending from one longitudinal edge to the other longitudinal edge of the cladding and comprising a block of foam of constant rectangular section and a metal tube embedded substantially in the centre of the block of foam.

8. A self-supporting element according to claim 1, having a V-shaped cross-section which has a vertical axis of symmetry passing through a longitudinal axis of the tie-member, the v having two wings inclined to the horizontal at an angle of substantially 45? , the V having a rounded base which has a concavity facing ends of the wings.

9. A self-supporting element according to claim 2, wherein each of the two lateral beams is provided with means for connecting the element to a neighbouring, parallel self-supporting element.

10. A self-supporting element according to claim 9, wherein the means for connecting the element to a neighbouring element comprise a fastening member which is fixed in facing longitudinal edge portions of the insulating claddings of said two elements to be interconnected.

11. A self-supporting element according to claim 10, wherein the wool fibres are interconnected in layers, each layer being formed by strips disposed in side-by-side relation and packed one against the other so as to achieve a required density, and connecting elements interconnecting the strips and disposed close to at least one surface of the layer, the layers wool fibres being of substantially constant length and separated from each other by inserts, each insert extending from one longitudinal edge to the other longitudinal edge of the cladding and comprising a block of foam of constant rectangular section and a metal tube embedded substantially in the centre of the block of foam, the fastening member being fixed to the end of the insert.

12. A self-supporting element according to claim 1, wherein the outer skin of the single-unit insulating cladding has longitudinal ribs which respectively extend continuously from one transverse end edge to the other transverse end edge of said cladding.

13. A self-supporting element according to claim 8, comprising, integrated in each wing of the cladding between the two skins, layers of wool fibres, each layer comprising strips and connecting elements interconnecting the strips and disposed close to at least one surface of the layer, the element further comprising, integrated in the rounded base of the cladding between the two skins, layers of wool fibres comprising strips and connecting elements which inconnect the strips and are disposed exclusively close to a surface of the layers in the rounded base which has the largest radius of curvature.

14. A self-supporting element according to claim 8, comprising, integrated in each wing of the cladding between the two skins, layers of wool fibres, each layer comprising strips and connecting elements interconnecting the strips and disposed close to at least one surface of the layer, the element further comprising, integrated in the rounded base of the cladding between the two skins, blankets of foam material developing good qualities of adhesion and fire resistance.

15. A self-supporting element according to claim 14, wherein said foam material of the blankets is of the polyurethane type.

16. A self-supporting element according to claim 14, wherein said foam material of the blankets is of the phenolic type.

17. A self-supporting element according to claim 15, wherein said foam material of the blankets contains fillers.

18. A self-supporting element according to claim 16, wherein said foam material of the blankets contains fillers.

19. A self-supporting element according to claim 5, comprising a U-sectioned rubber sealing element covering each of the two longitudinal edge portions of the cladding, the sealing element having wings which cover the marginal portions of the external surfaces of the outer skin and inner skin, the wing of the U-sectioned sealing element which covers the marginal portion of the inner skin also bearing against a lateral beam, said sealing element extending continuously from one transverse end edge to the other transverse end edge of said cladding.

20. A self-supporting element according to claim 8, wherein a wing of the V which is the most oriented toward the North is provided with openings between two neighbouring inserts, said openings each being provided with a translucent skylight connected to the cladding by a peripheral sealing element having two lip portions which grip the external surfaces of the two skins and two other lip portions which grip marginal portions of the skylight.

21. A self-supporting element according to claim 20, wherein the openings are arranged at the pitch of two neighbouring inserts.

22. A self-supporting element according to claim 20, wherein the openings are arranged at a multiple of the pitch of two neighbouring inserts.

23. A self-supporting element according to claim 1, comprising technical devices ensuring at least one function selected from the functions comprising heating, artificial lighting, discharge of condensations and fire protection of the roofed building.

24. A self-supporting element according to claim 7, wherein the inserts are adhered to the internal surface of the inner skin and have no connection other than friction with the internal surface of the outer skin.

25. A self-supporting element according to claim 8, having an upwardly open V shape, the rounded base thereof constituting a gutter discharging rainwater.

26. A self-supporting element according to claim 25, wherein the cladding thereof is completed by a ridge structure covering a longitudinal edge portion of a first element and a longitudinal edge portion of a neighbouring second element after the assembly of the second element with the first element, each ridge structure being made from a plurality of sections each of which is fixed by clipping to uncovered wings of the U-sectioned sealing elements fixed to two confronting longitudinal edge portions of said two assembled elements.

27. A self-supporting element according to claim 26, wherein at least one of the sections of the ridge structures is combined with means for ejecting the at least one section beyond a certain degree of heat.

28. A self-supporting element according to claim 1, wherein the two skins of the single-unit insulating cladding are of a material selected from the group comprising a prelacquered aluminium sheet, an aluminium alloy sheet, a stainless steel sheet, a zinc sheet, a copper sheet, and a lead-coated sheet.

29. An insulating cladding for construcing a self-supporting element comprising a framework and said cladding, said cladding being in a single unit and formed by a composite comprising: an outer skin resisting corrosions, an inner skin substantially of the same configurations as the outer skin and disposed parallel to and under the outer skin; and an insulating blanket comprising at least partly mineral wool fibres which extend in a direction substantially perpendicular to parallel planes of the skins and which are glued at their ends to the inside faces of said outer and inner skins, respectively.

30. A building roof comprising a combination of a plurality of self-supporting elements disposed parallel to each other, each self-supporting element having two longitudinal edges, a front transverse end edge, a rear transverse end edge, and a longitudinal plane of symmetry and comprising:

(a) a framework of metal section members extending continuously between said two longitudinal edges and between said two transverse end edges so as to ensure a self-supporting character of said element, and (b) an insulating cladding detachably supported by said framework, said cladding being in a single unit and formed by a composite comprising: an outer skin resisting corrosions, an inner skin substantially of the same configuration as the outer skin and disposed parallel to and under the outer skin; and an insulating blanket comprising at least partly mineral wool fibres which extend in a direction substantially perpendicular to parallel planes of the skins and which are glued at their ends to the inside faces of said outer and inner skins, respectively, said parallel self-supporting elements being assembled in pairs along the longitudinal edges thereof.

* * * * *